US012673233B2

(12) United States Patent
Jorgensen et al.

(10) Patent No.: US 12,673,233 B2
(45) Date of Patent: Jul. 7, 2026

(54) EXERCISE BENCH WITH DEEP PASSTHROUGH INSETS

(71) Applicants: Kasper Overaa Jorgensen, Las Vegas, NV (US); Jeffrey T. Jay, Las Vegas, NV (US)

(72) Inventors: Kasper Overaa Jorgensen, Las Vegas, NV (US); Jeffrey T. Jay, Las Vegas, NV (US)

( * ) Notice: Subject to any disclaimer, the term of this patent is extended or adjusted under 35 U.S.C. 154(b) by 0 days.

(21) Appl. No.: 18/639,757

(22) Filed: Apr. 18, 2024

(65) Prior Publication Data

US 2024/0350857 A1 Oct. 24, 2024

Related U.S. Application Data

(60) Provisional application No. 63/460,120, filed on Apr. 18, 2023.

(51) Int. Cl.
*A63B 21/00* (2006.01)

(52) U.S. Cl.
CPC .. *A63B 21/4029* (2015.10); *A63B 2208/0247* (2013.01); *A63B 2208/0252* (2013.01)

(58) Field of Classification Search
CPC ... A63B 21/158; A63B 21/4029; A63B 21/40; A63B 21/4031; A63B 21/4027; A63B 2208/0252; A63B 21/008; A63B 22/001
See application file for complete search history.

(56) References Cited

U.S. PATENT DOCUMENTS 4,621,809 A * 11/1986 Pearl ..... A63B 21/4029 482/104
4,861,024 A * 8/1989 Lee ..... A63B 21/4047 482/104
4,861,025 A * 8/1989 Rockwell ..... A63B 21/06 482/142
5,125,881 A * 6/1992 Jones ..... A63B 23/1245 482/93
5,348,523 A * 9/1994 Blount ..... A63B 21/078 5/652
5,649,886 A * 7/1997 Danylieko ..... A63B 21/4029 482/142
D415,222 S * 10/1999 Palmer ..... D21/690
8,151,812 B2 * 4/2012 Razon ..... A61H 3/04 297/195.1
8,864,233 B2 * 10/2014 Wei ..... A47C 1/022 297/195.11
9,248,337 B1 * 2/2016 Humphrey ..... A63B 21/00181
(Continued)

*Primary Examiner* — Garrett K Atkinson
(74) *Attorney, Agent, or Firm* — Lee & Hayes, P.C.

(57) ABSTRACT

In one embodiment, an exercise bench with deep passthrough insets is disclosed herein. In particular, the present disclosure provides an improved weightlifting and exercise bench having a frame, and a generally rectangular platform supported by said frame, where the generally rectangular platform comprises a solid base member and a flexible resilient pad member covering the base member. Both the base member and the pad member are generally the same area and rectangular, except that a semicircular, circular, rectangular, or similarly shaped cutout is provided through both the solid based member and the resilient pad member in the region adjacent the position of a user's shoulder blades if such user were disposed on said platform in position to perform bench presses or similar exercises.

11 Claims, 21 Drawing Sheets

(56) References Cited

U.S. PATENT DOCUMENTS

| | | | | |
|---|---|---|---|---|
| 2003/0220176 | A1* | 11/2003 | O'Connor | A63B 21/4029 482/142 |
| 2010/0249495 | A1* | 9/2010 | Siradag | A47C 11/00 600/38 |
| 2015/0224359 | A1* | 8/2015 | Kalleen | A63B 21/4029 482/104 |
| 2015/0246259 | A1* | 9/2015 | Stoesslein | A63B 21/4029 482/142 |
| 2022/0143447 | A1* | 5/2022 | Johnston | A63B 21/4029 |
| 2022/0266086 | A1* | 8/2022 | Harvot | A63B 21/4029 |
| 2022/0314059 | A1* | 10/2022 | Rojas | A63B 21/4039 |

* cited by examiner

EXERCISE BENCH WITH DEEP PASSTHROUGH INSETS

RELATED APPLICATION

This application claims priority to U.S. Provisional Application No. 63/460,120, filed Apr. 18, 2023, entitled EXERCISE BENCH WITH DEEP PASSTHROUGH INSETS, by Kasper Overaa Jorgensen, et al., the contents of which are incorporated herein by reference.

TECHNICAL FIELD

The present disclosure relates to the field of physical exercise equipment, and more particularly, to an improved weightlifting and exercise bench of the type used to perform free weight and barbell exercises and leg exercises.

BACKGROUND

The very first chest exercises were based on laying directly on the ground. The original exercise bench, which is still largely in use, was later designed to have a flat raised horizontal platform supported by a frame upon which a user lies while performing various upper body exercises, such as bench presses and pullovers (which develop, for example, to a greater or lesser degree, the trapezium, latissimus dorsi, the deltoids, the biceps, subscapularis, triceps, pectoralis major and minor, the intercostals, transversalis, rectus abdominis, the internal and external oblique and quadratus muscle groups).

While it was an improvement over laying on the ground, the use of this original bench still had limitations, though has been slowly improved upon throughout the development of weightlifting. For example, vertical support members at one end of the bench that extend above the level of the platform and "J"-shaped hook members were added to the upper portions of the extended vertical support members, thereby allowing the barbell weights to be supported behind the user's head. Additional improvements involved means for slanting the head end of the bench upward relative to the horizontal portion of the end of the platform supporting a user's trunk. Using the aforementioned configuration, a weightlifter, by bench pressing with his upper torso inclined upward from a horizontal position, is required to use certain muscle groups of the upper chest and shoulders, such as the pectoralis major and minor and the deltoids, which muscle groups would not otherwise be exercised to the same extent. Still further advancements include leg exercise attachments, decline settings, and so on.

One disadvantage of prior art weightlifting benches and inclined benches, which may be noted particularly during bench presses and dumbbell flies, is that the generally rectangular shape of the bench does not conform well to the physiology of the user during such exercises. During such exercises, the shoulder blades of the user are pressed into the bench and are restricted from articulating by the bench surface. If the shoulders can't move, however, the user cannot properly contract the chest muscles. It would be desirable, therefore, to provide a bench which permits freer articulated movement of the shoulder blades.

In addition to laying down, many exercises involving a weight bench are based on the user sitting on the bench. However, many exercise positions performed while sitting on the bench have improper form based on obstruction by the bench or orientation of the body. For example, performing dumbbell curls while sitting on the bench has either the bench itself in the way of full extensions, or else the user may be forced to widen their arms to get the weights around their legs. It would also be desirable, therefore, to provide a bench which permits freer movement of the user during a multitude of different exercises.

SUMMARY

According to various embodiments herein, an exercise bench with deep passthrough insets is introduced. In particular, the present disclosure provides an improved weightlifting and exercise bench having a frame, and a generally rectangular platform supported by said frame, where the generally rectangular platform comprises a solid base member and a flexible resilient pad member covering the base member. Both the base member and the pad member are generally the same area and rectangular, except that a semicircular, circular, rectangular, or similarly shaped cutout is provided through both the solid based member and the resilient pad member in the region adjacent the position of a user's shoulder blades if such user were disposed on said platform in position to perform bench presses or similar exercises. This construction permits completely free, comfortable, and unencumbered vertical movement of the user's arms and shoulders and articulation of the shoulder blades when the user is lying on the platform, and also allows for placement of the user's legs while sitting on the bench for better user positioning during various basic exercises.

In one specific embodiment, an exercise bench herein comprises: a frame having a top and bottom and a frame head-end and a frame tail-end at a distal end of the frame from the frame head-end; one or more head-end legs extending downward from the bottom of the frame head-end, the one or more head-end legs collectively establishing a head-end base at least as wide as the frame; one or more tail-end legs extending downward from the bottom of the frame tail-end, the one or more head-end legs collectively establishing a tail-end base at least as wide as the frame; and a user-support platform having: i) a solid base member supported by the top of the frame, the solid base member being generally rectangular and extending lengthwise from the frame head-end to the frame tail-end, and ii) a flexible resilient pad on top of the solid base member and configured in a substantially similar shape as the solid base member; wherein the user-support platform has first and second insets formed opposite each other and along opposing sides of the user-support platform, the first and second insets similarly formed within both the solid base member and the flexible resilient pad and located within a region of the user-support platform that would align with shoulder blades of a user lying against the user-support platform, the first and second insets being sufficiently deep enough to allow the shoulder blades of the user to have unencumbered mobility while the user was lying against the user-support platform while a spine of the user remains centrally supported by a portion of the user-support platform between the first and second insets, and wherein the frame exists under the portion of the user-support platform between the first and second insets.

Additional features of the present invention are discussed in the detailed description of the preferred embodiment below, and shown in the drawings hereof, and this summary is not meant to limit the scope of the embodiments herein.

BRIEF DESCRIPTION OF THE DRA WINGS

The embodiments herein may be better understood by referring to the following description in conjunction with the accompanying drawings in which like reference numerals indicate identically or functionally similar elements, of which:

DETAILED DESCRIPTION

Figure 1A:
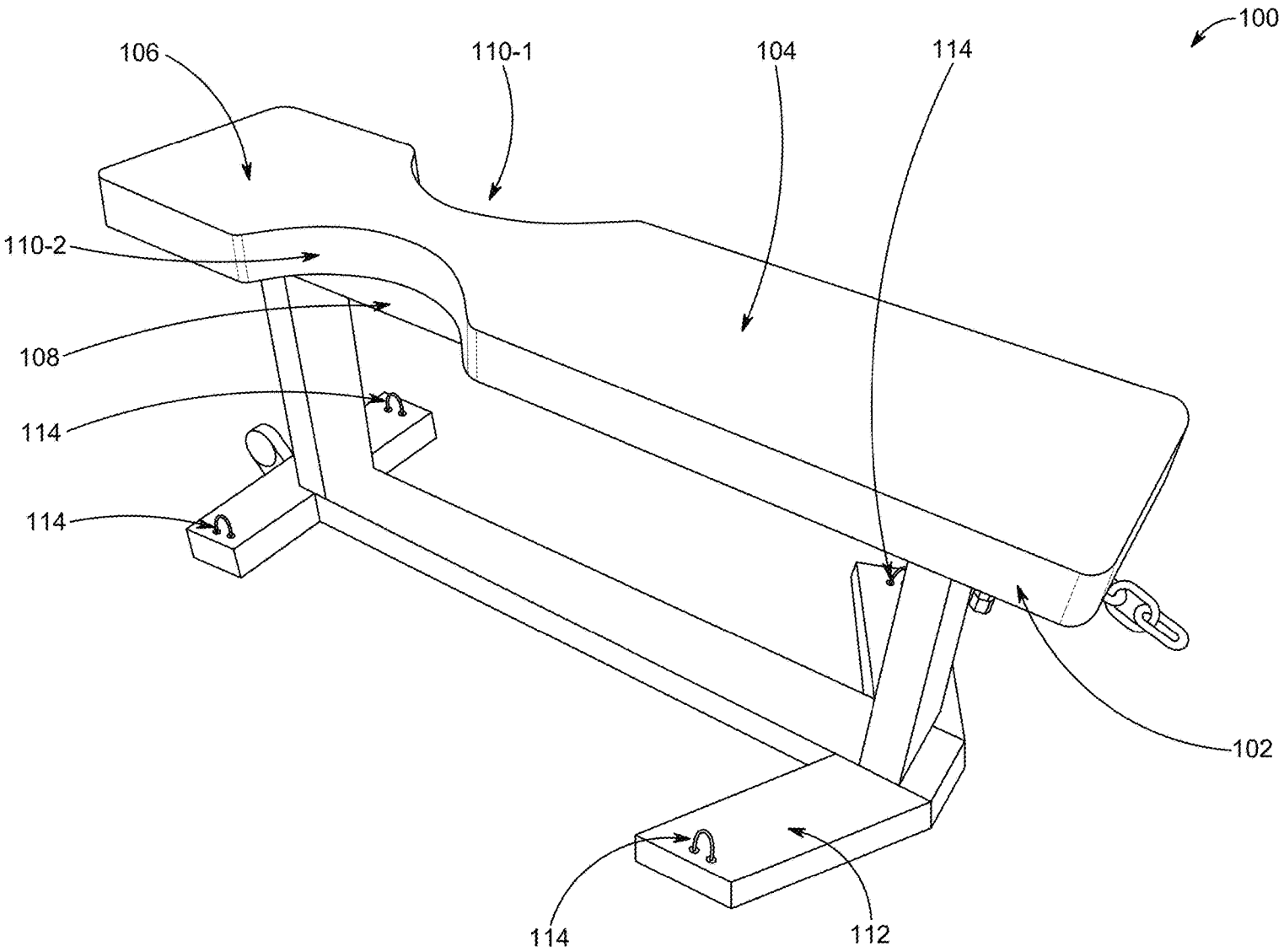
FIGS. 1A-1D, illustrate examples of embodiments of an exercise bench with deep passthrough insets according to the present disclosure.
Figure 1B:
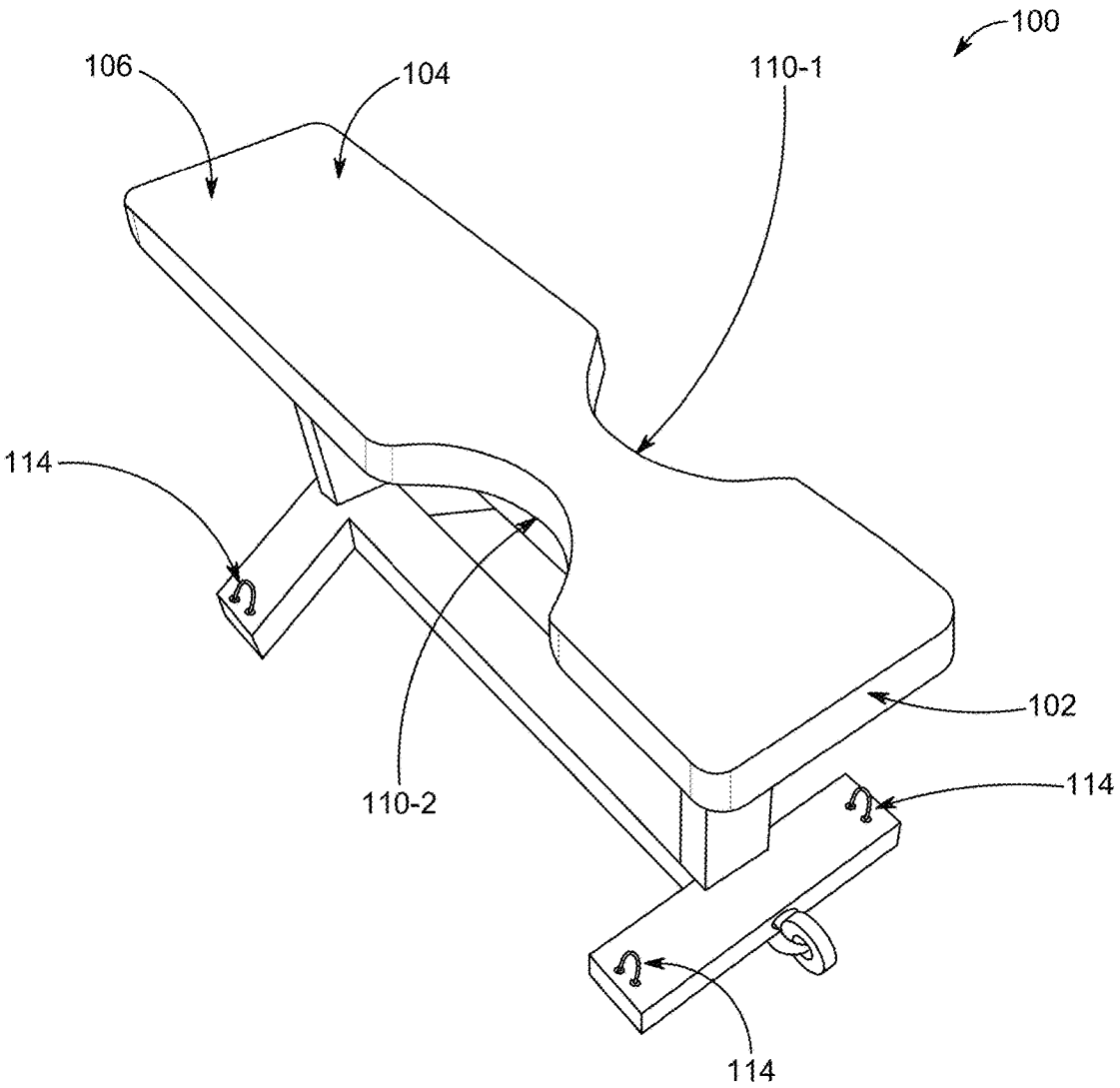
Figure 1C:
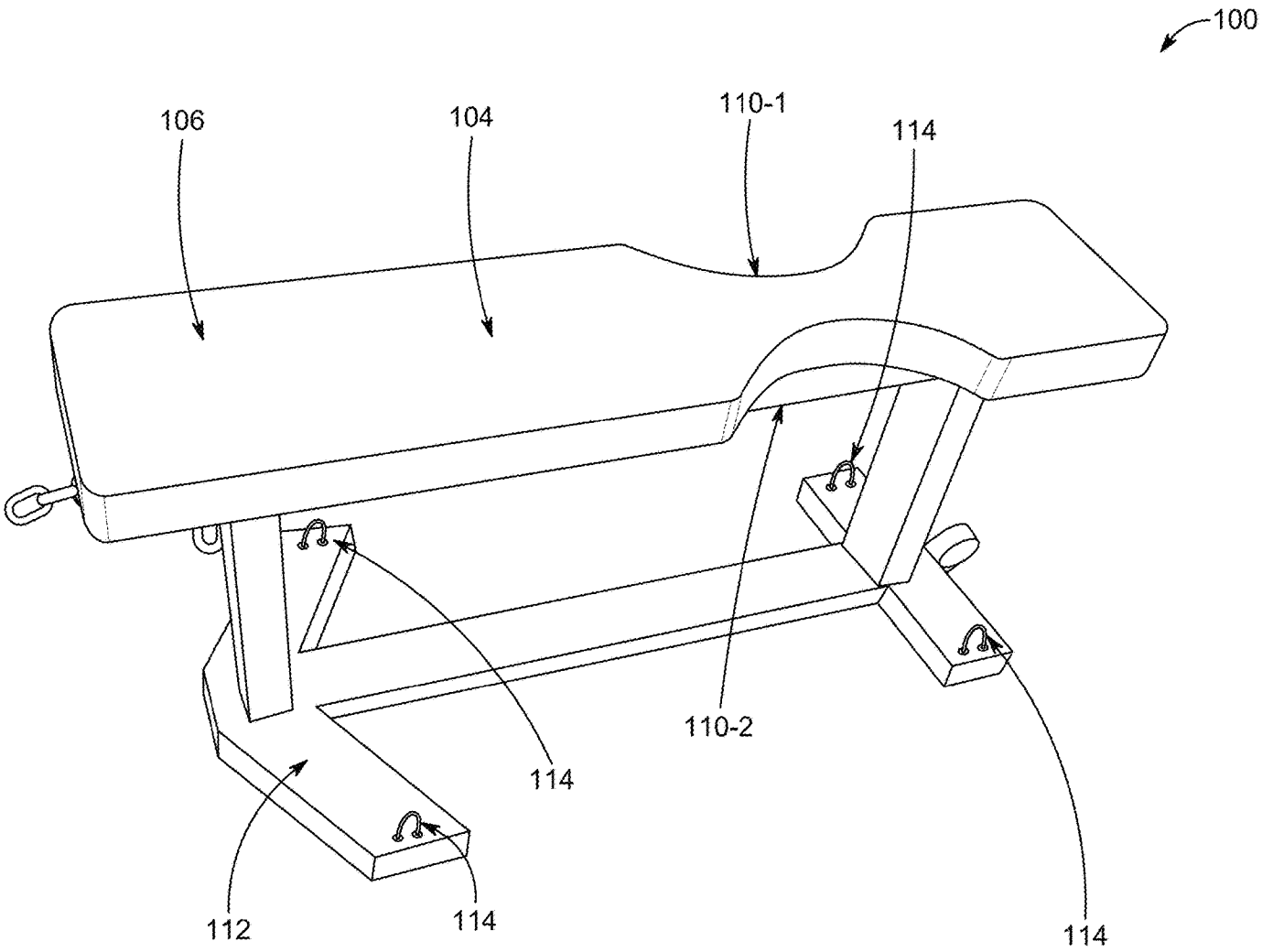
Figure 1D:
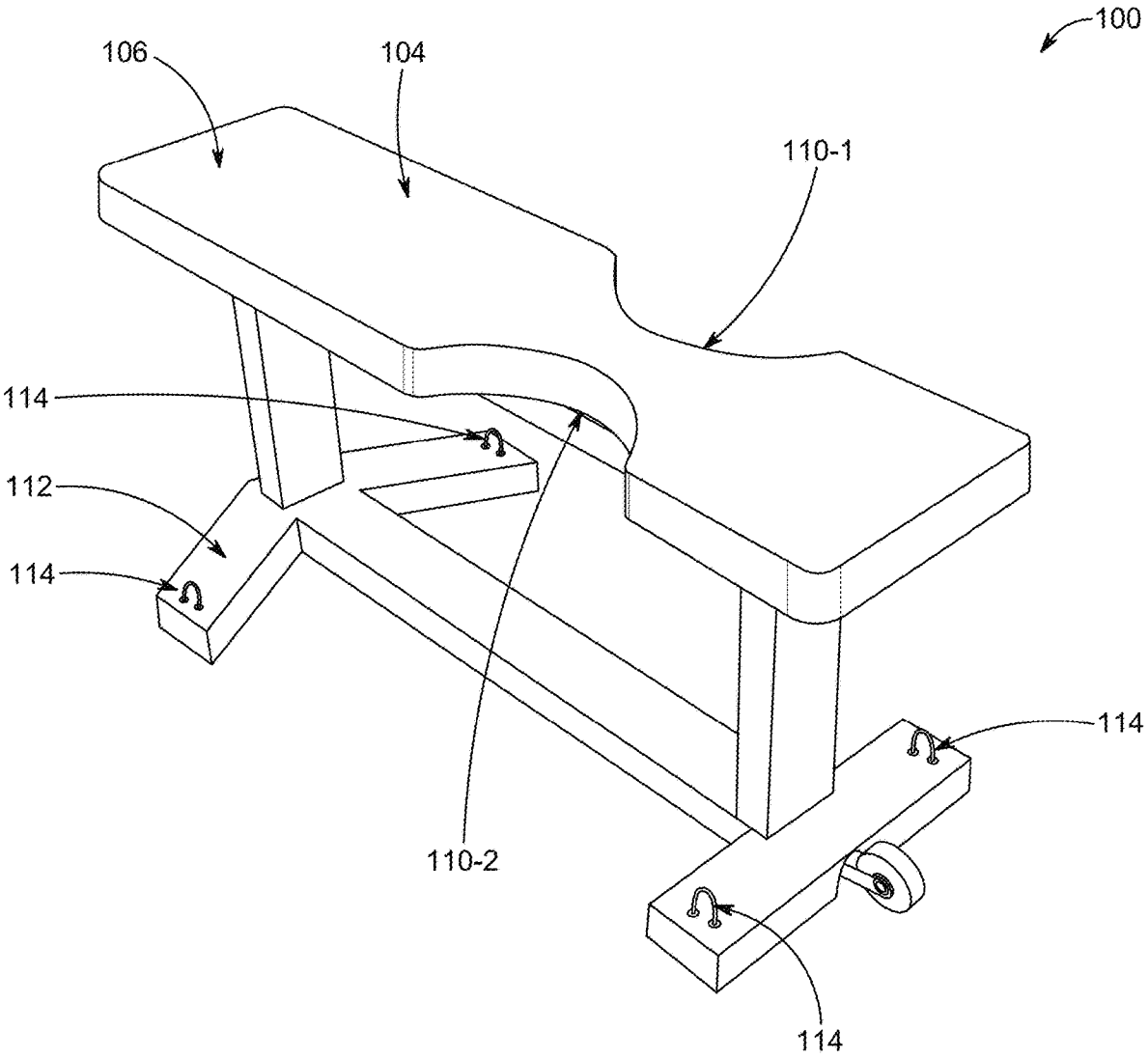

The present disclosure introduces an exercise bench with deep passthrough insets specially designed to avoid shoulder injuries while performing chest exercises, and increase isolation of particular exercises. In some embodiments, the improved weightlifting and exercise bench has a frame, and a generally rectangular platform supported by said frame, where the generally rectangular platform comprises a solid base member and a flexible resilient pad member covering the base member. Both the base member and the pad member are generally the same area and rectangular, except that a semicircular, circular, rectangular or similarly shaped cutout is provided through both the solid based member and the resilient pad member in the region adjacent the position of a user's shoulder blades if such user were disposed on said platform in position to perform bench presses or similar exercises. This construction permits completely free, comfortable and unencumbered vertical movement of the user's arms and shoulders and articulation of the shoulder blades when the user is lying on the platform, and also allows for placement of the user's legs while sitting on the bench for better user positioning during various basic exercises. It is to be understood that the invention is not limited in its application to the details of construction and the arrangement of components described hereinafter and illustrated in the figures. Those skilled in the art will recognize that various modifications can be made without departing from the scope of the invention.

As is generally shown in FIGS. 1A-1D, a raised platform is comprised of a solid member 102, a flexible, resilient pad member 104, and a cover member 106, all supported on the bench 100 on an upper frame member 108. As shown, both the solid member 102 and pad member 104 comprises two cutouts 110-1, 110-2, preferably generally semi-oval in shape, or other suitable shape disposed near the side edges of the head section platform. The cutouts 110-1, 110-2 ("deep passthrough insets") are disposed along the sides of the head section platform such that they would be positioned under the shoulder blades of most users when lying on the bench, and are deep enough to allow the entire shoulder blade of the user to have unencumbered mobility, while the spine remains centrally supported. Notably, regardless of the shape of the cutouts, the pad member is configured in substantially the same shape as the solid member 102, as shown.

The cutouts 110-1, 110-2 and provide the user with the freedom of movement of his shoulders and shoulder blades during the performance of exercises while the user is lying on his back. For a general example, when performing bench presses, as the user lowers his arms, his elbows and shoulders drop and his shoulder blades articulate and are forced back below the plane of the platform without restriction. At the same time, the remainder of the user's body, including his back, hips and legs, can be comfortably disposed on a standard wide bench. The alternative, making a generally narrow bench which does not interfere with the user's movement, would not provide an effective alternative because the bench would be too narrow to be generally comfortable and would be too narrow to be stable for the user who may be lifting extremely heavy weights. Alternatively, if the user is lying on his stomach on the bench, the user's shoulders can drop below the plane of the platform.

The pad member 104 is preferably of sufficient thickness and density to provide a reasonable amount of support and comfort to the user. The cover member 106 can be plastic, leather, or other suitable material known in the art.

As also shown in FIGS. 1A-1D, at the foot-end of the bench (away from the head/shoulder end), the legs of the bench may have a base 112 (e.g., "feet") that are angled inwards so the user's heels won't touch the bench while performing exercises. There is also a handle illustratively beneath the platform at one end (e.g., the foot-end) of the bench, and one or more wheels on the base at the opposing end (e.g., the head-end) of the bench for ease of moving the bench around to different location.

Notably, the construction of the bench allows it to be strong enough to support the wright of the user and any additional exercise weights, while still itself weighing less than 40 pounds.

In one embodiment, there may be various rings/hooks 114 located on the base of the bench, e.g., the four corners/feet of the bench, to allow for various attachments, such as for anchoring rubber band exercise equipment or otherwise.

Figure 2A:
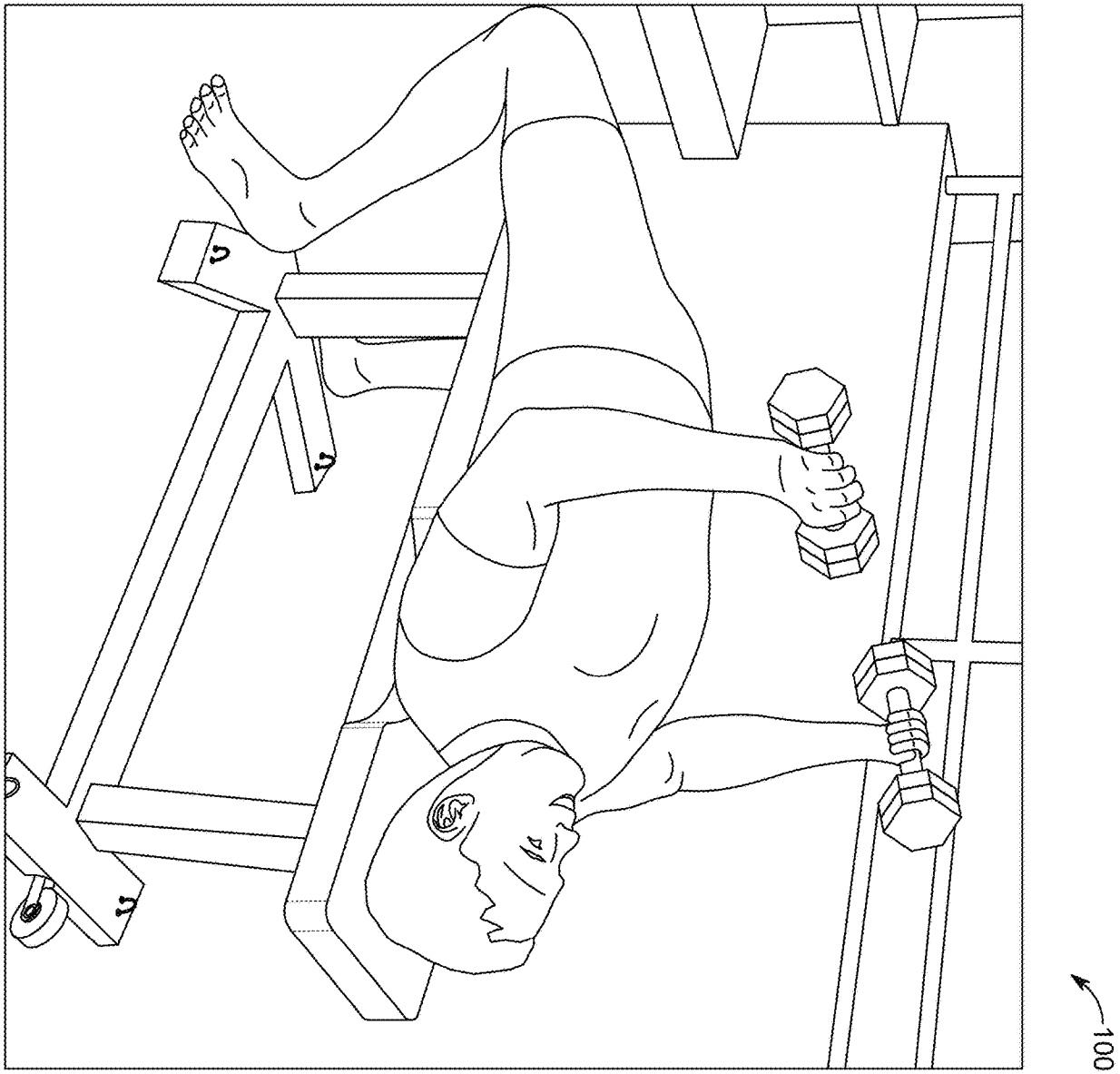
FIGS. 2A-2O illustrate examples of uses of an exercise bench with deep passthrough insets according to the present disclosure.
Figure 2B:
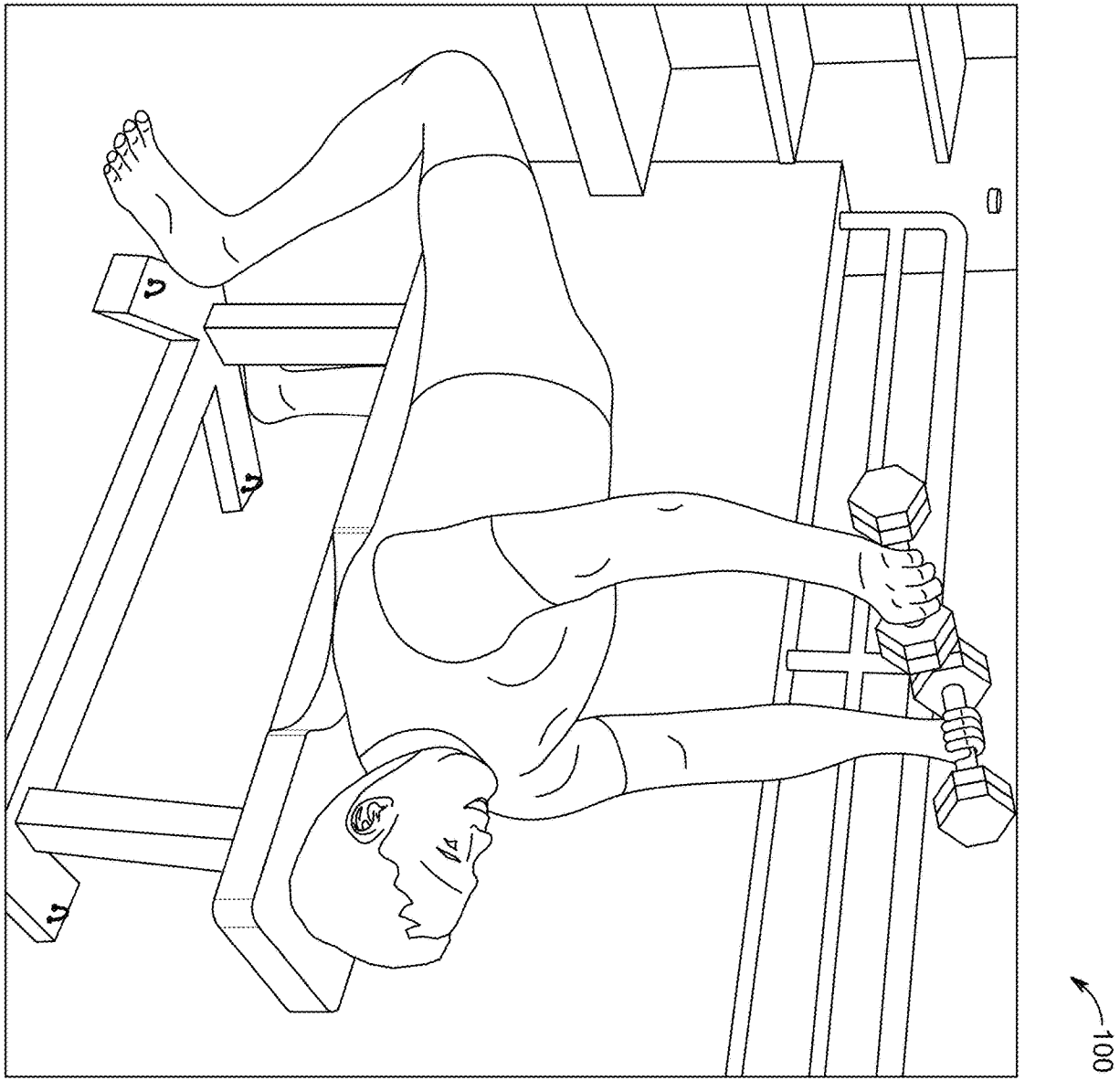
Figure 2C:
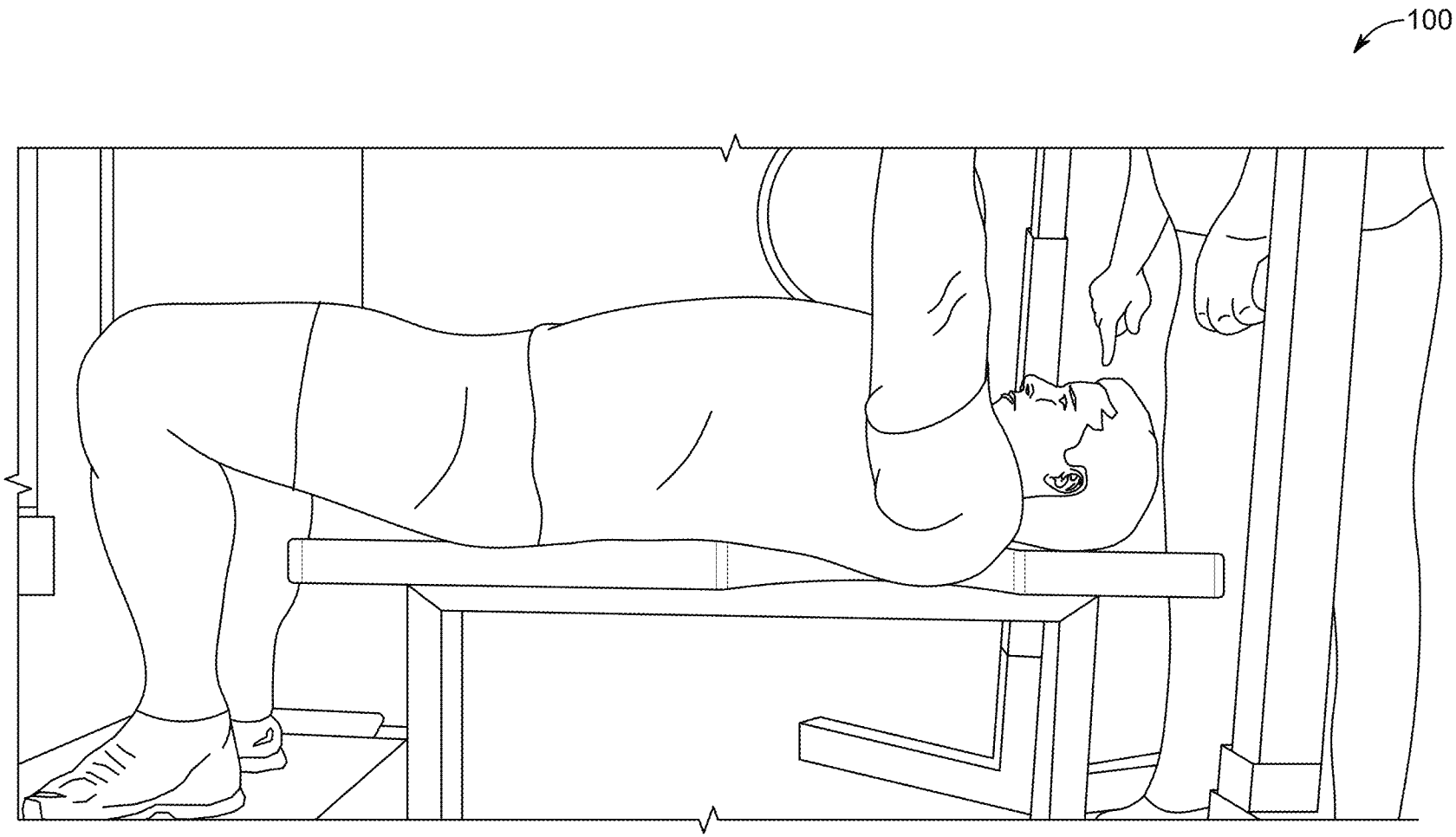
Figure 2D:
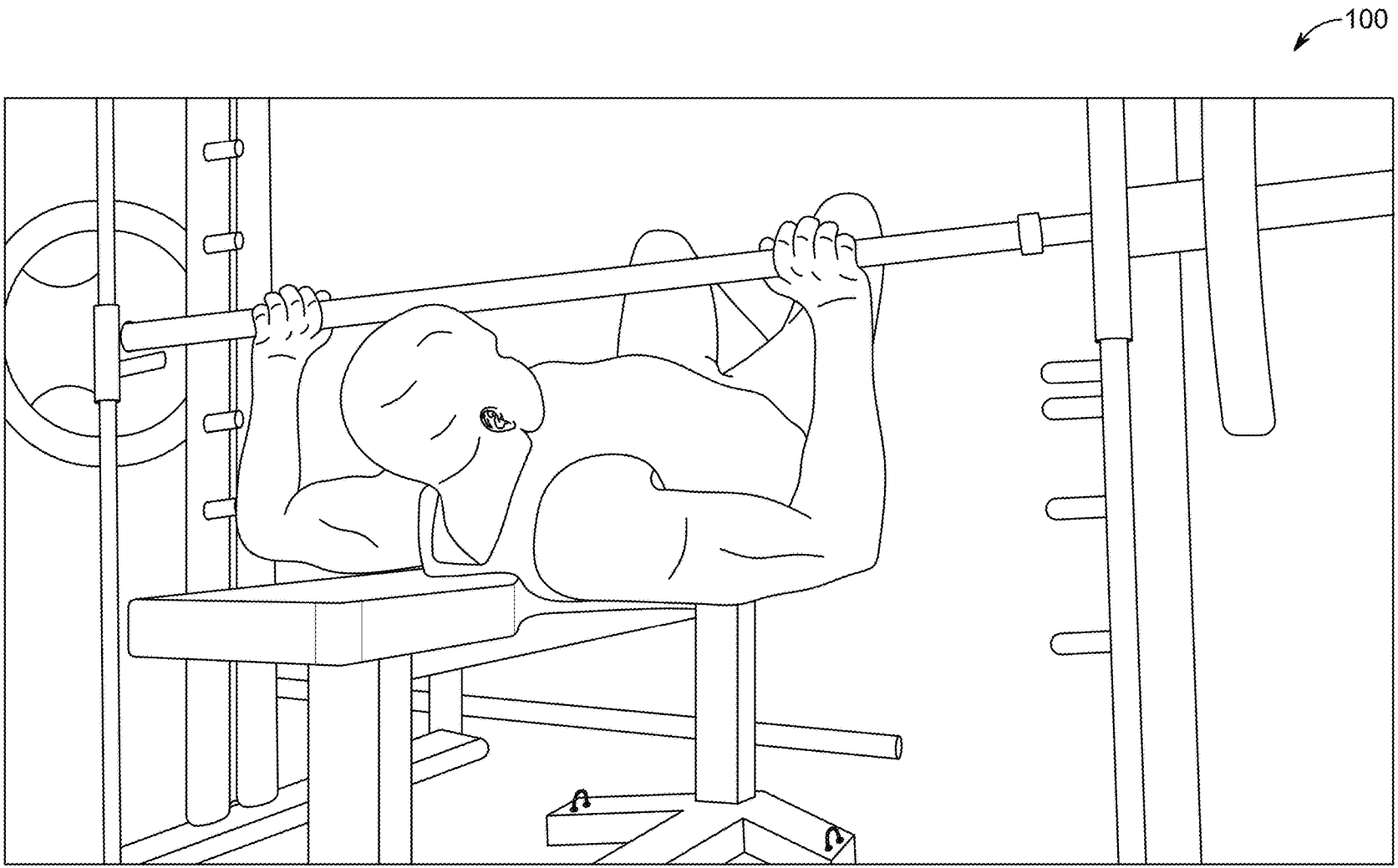

FIGS. 2A-2O illustrate examples of exercises using the bench 100 herein. For example, FIG. 2A illustrates a basic dumbbell exercise for the chest, where the user lays on the bench, and can immediately feel their shoulders falling into the hole/aperture of the deep passthrough insets/cutouts. With their arms already extended upward, the user can perform this simple exercise by contracting the chest only, raising the straight arms as shown in FIG. 2B, isolating the chest (contracting only the chest muscles). As shown in FIGS. 2C and 2D, standard bench presses may also be performed using the bench, whether with free weights, a machine, a rack, and so on.

Figure 2E:
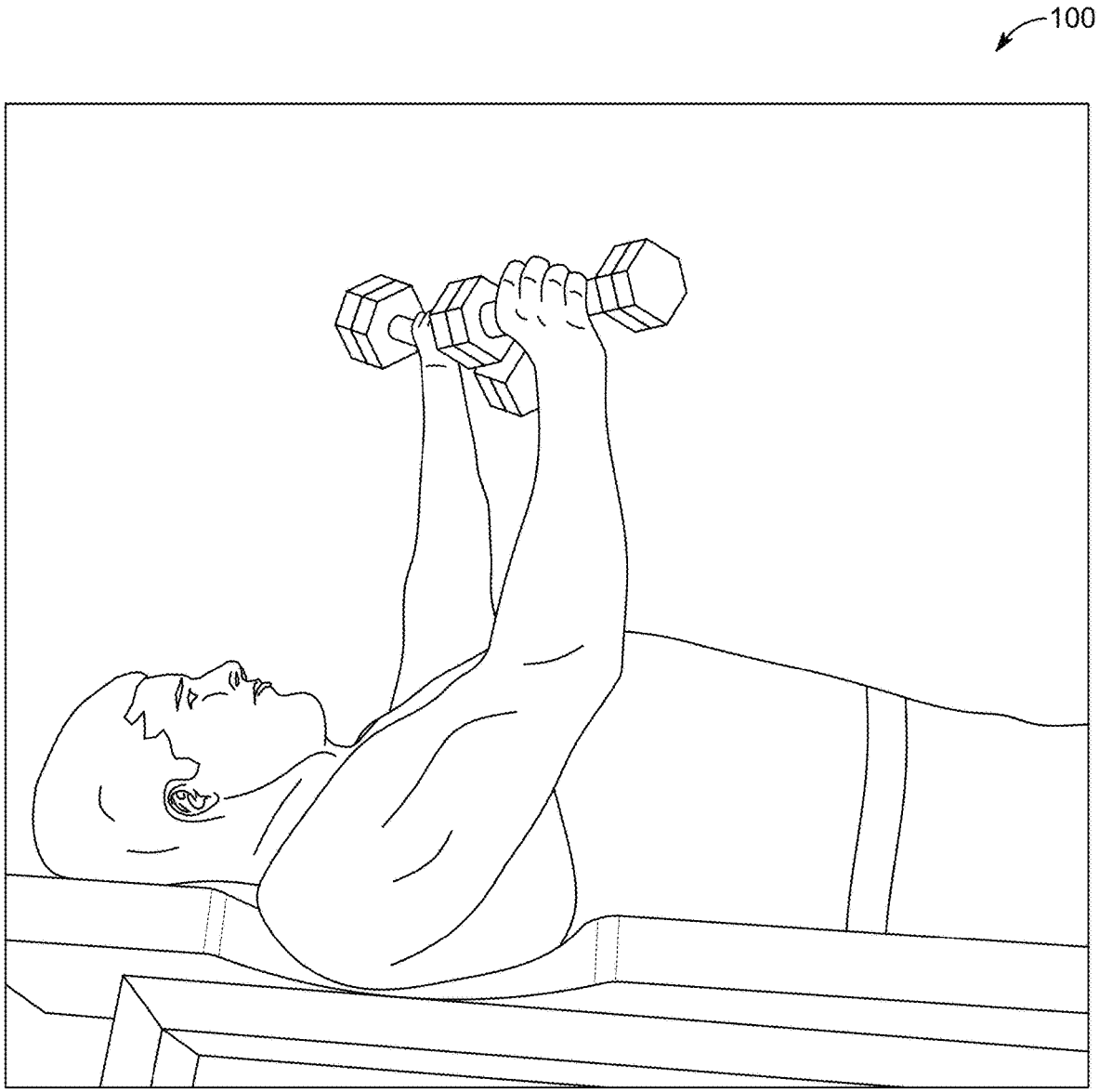

FIG. 2E illustrates how the deep insets of the weight bench herein are also great for single-arm presses with dumbbells for even more isolation of movement of the chest muscles (right pectoral/chest or left pectoral/chest, one at a time). This movement has no change on rotation in the shoulder while allowing the user to push upward with one arm at a time. Notably, single-arm movements and strength exercises are great not only for enhanced isolation training, but also for physical therapy exercises which require moving only one arm at a time. (Traditionally, such physical therapy exercises require that the user lay along one edge of a bench in order to allow such movements.)

Figure 2F:
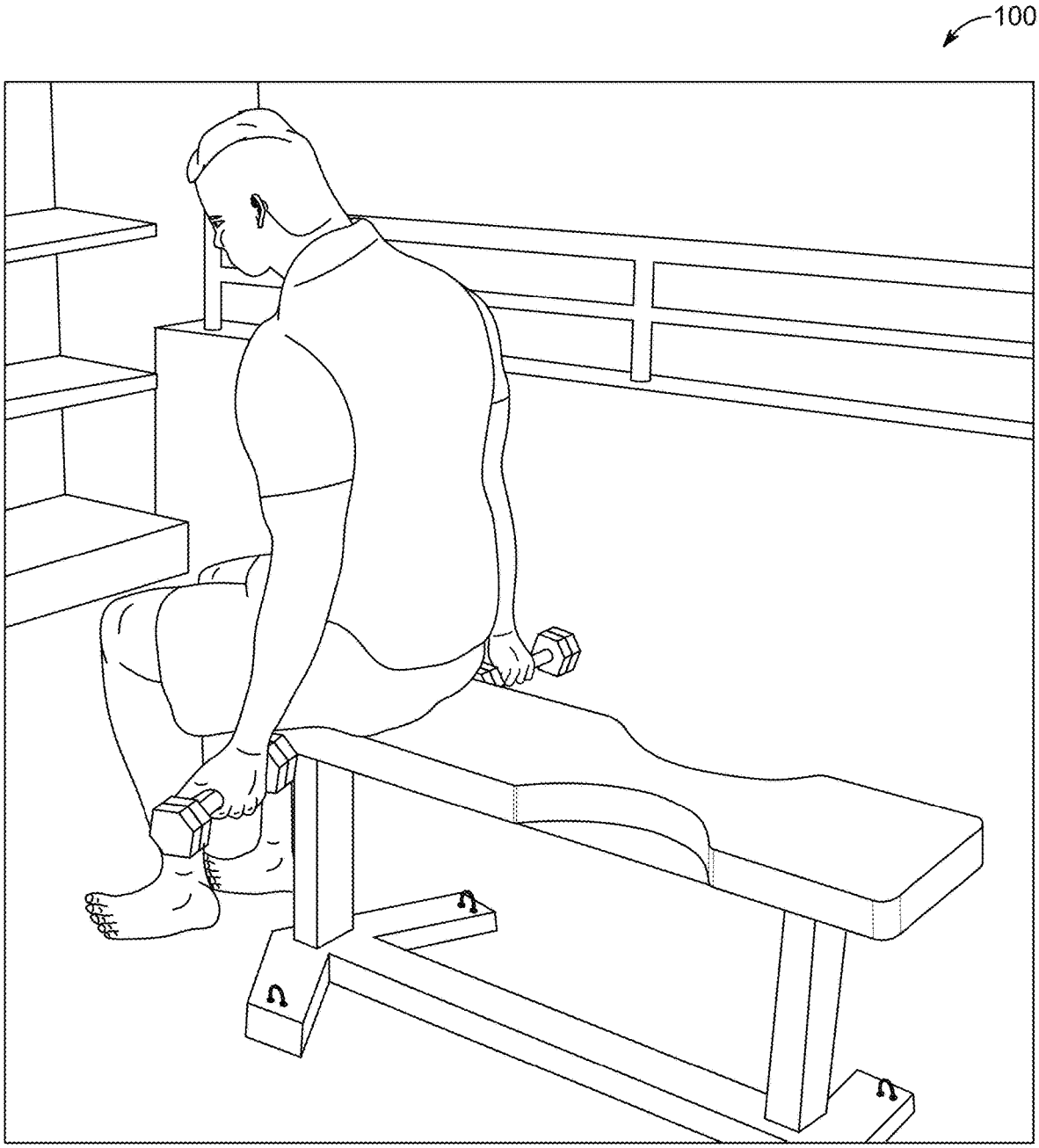
Figure 2G:
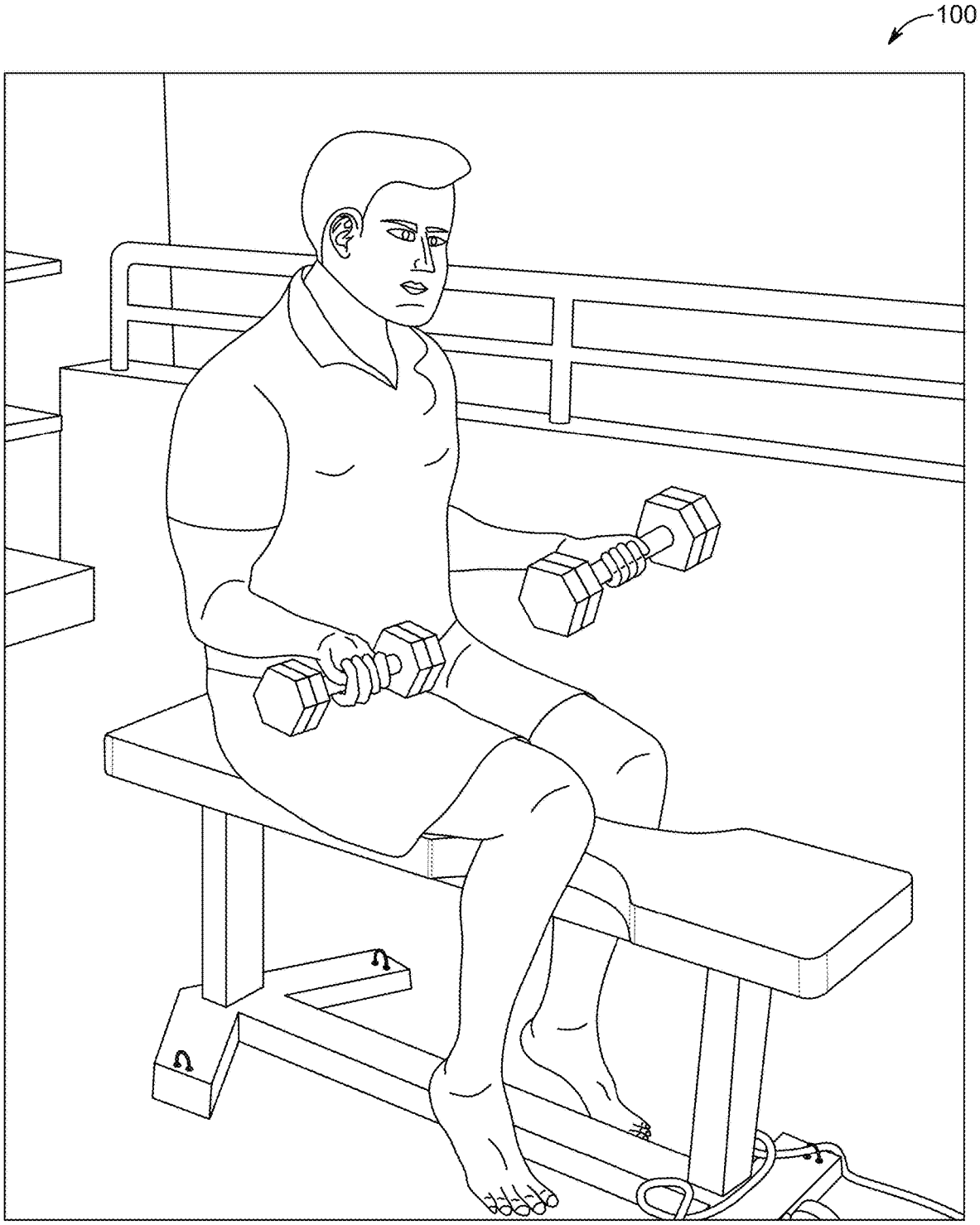
Figure 2H:
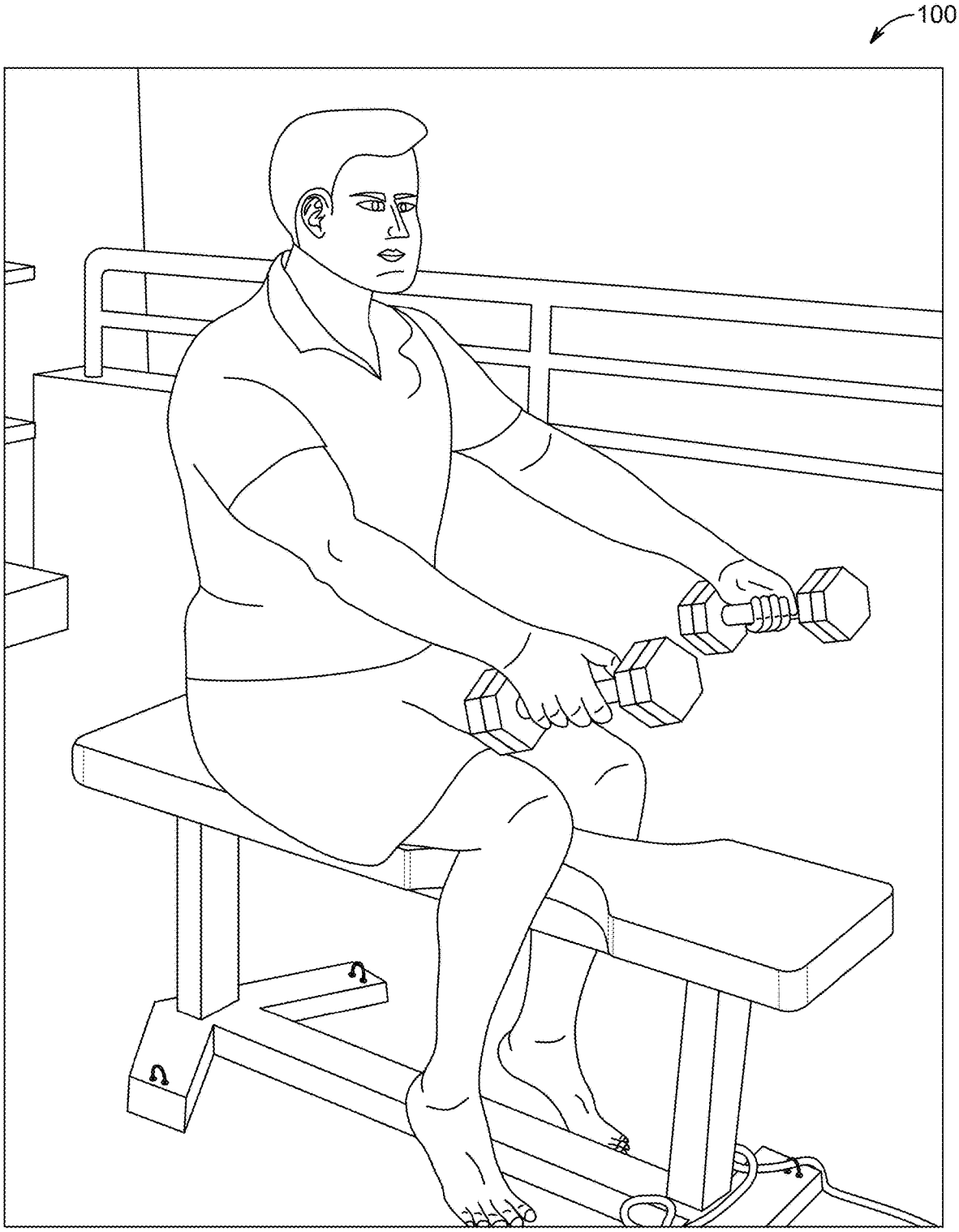
Figure 2I:
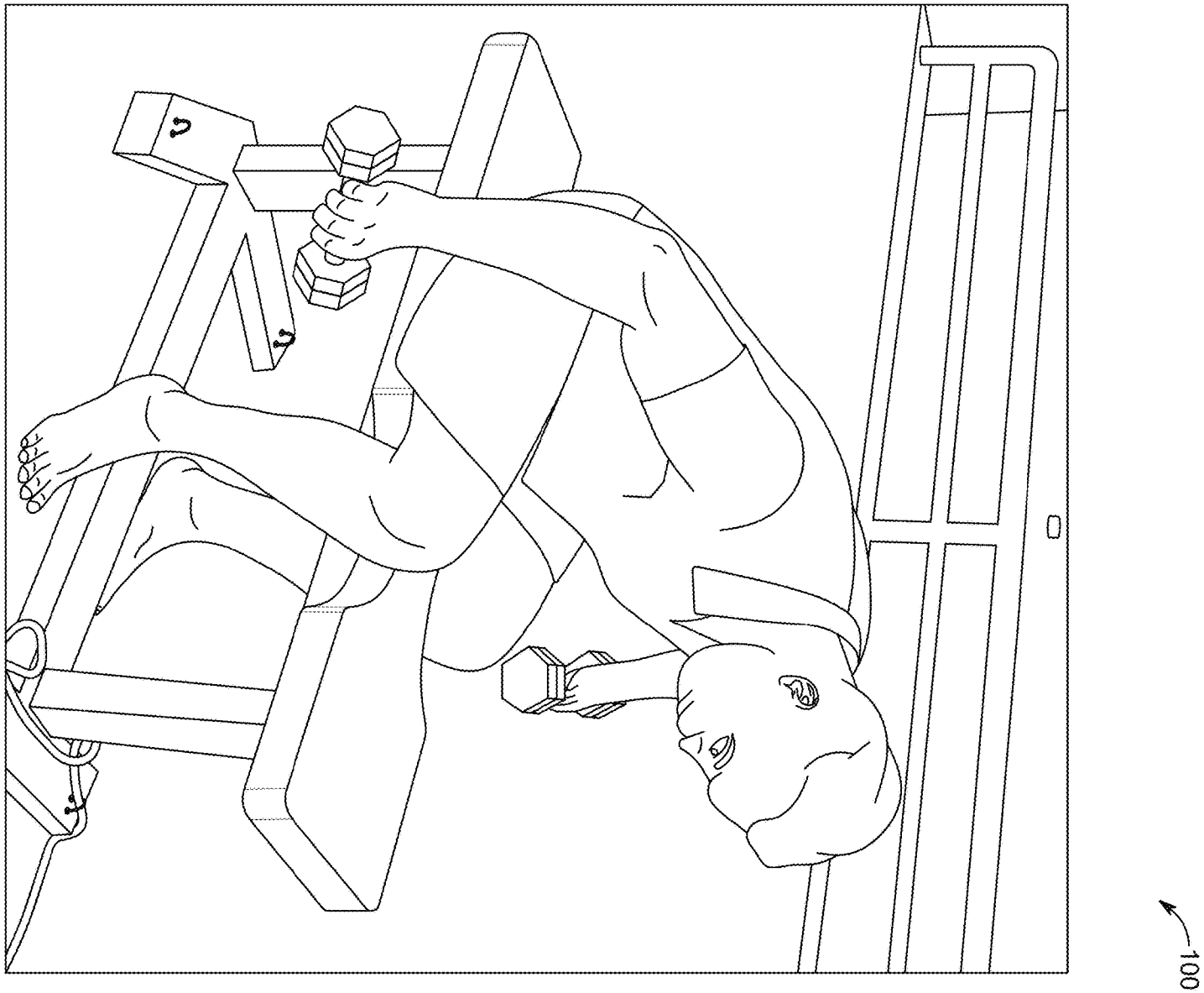

As shown in FIG. 2F, a user may traditionally sit up on the foot-end of the bench to perform exercises such as dumbbell curls. However, this can be difficult to maneuver the weights past the user's legs, stressing the shoulders, or potentially hitting the user's legs with the weights. By using the bench herein, however, as shown in FIG. 2G, the user may turn around and place their legs (knees) within the deep passthrough insets/cutouts, allowing them to perform unencumbered bicep curls. Additionally, as shown in FIGS. 2H-2I, the user may also perform front deltoid raises, rear deltoid raises, side deltoid raises, etc. from this position.

Figure 2J:
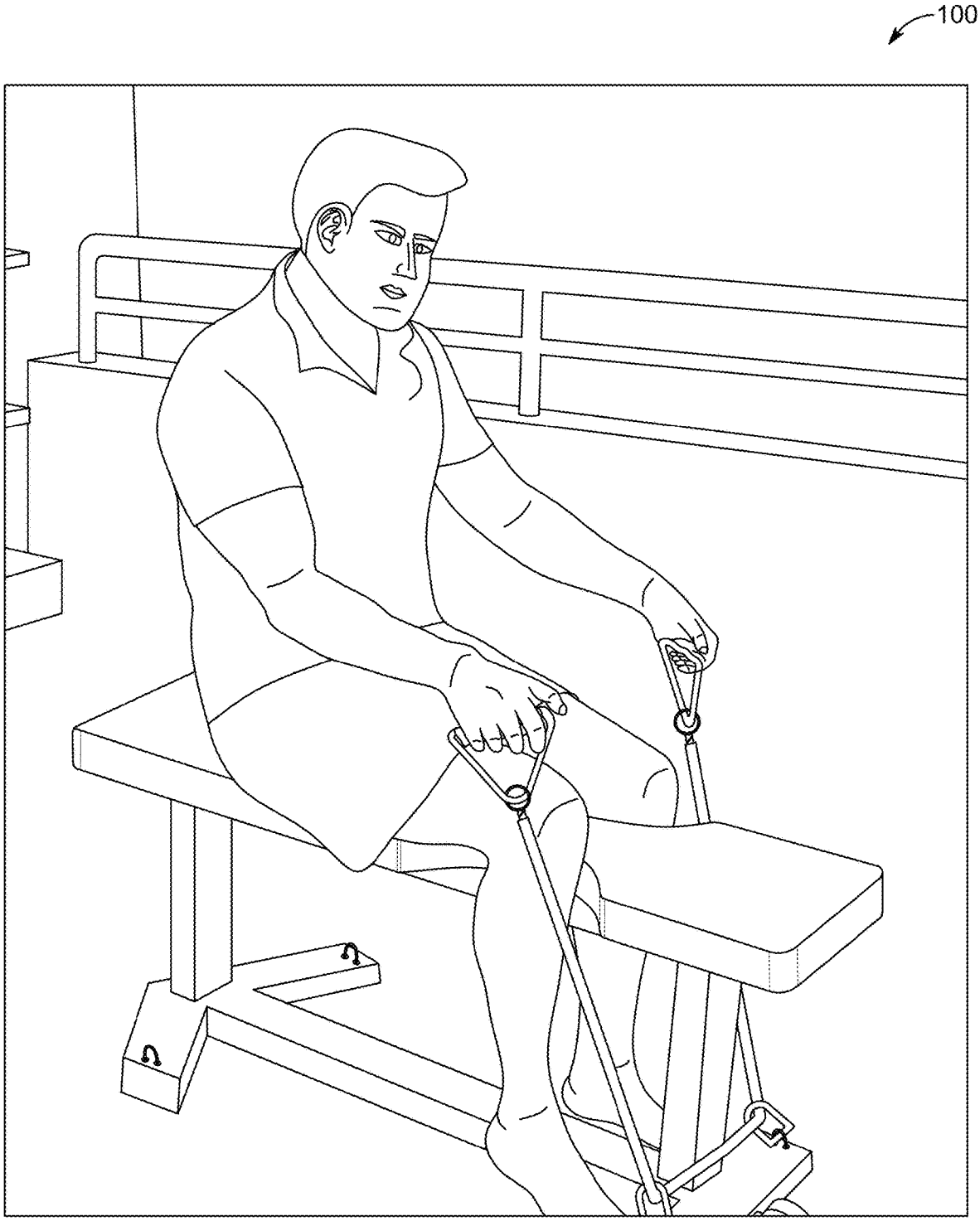
Figure 2K:
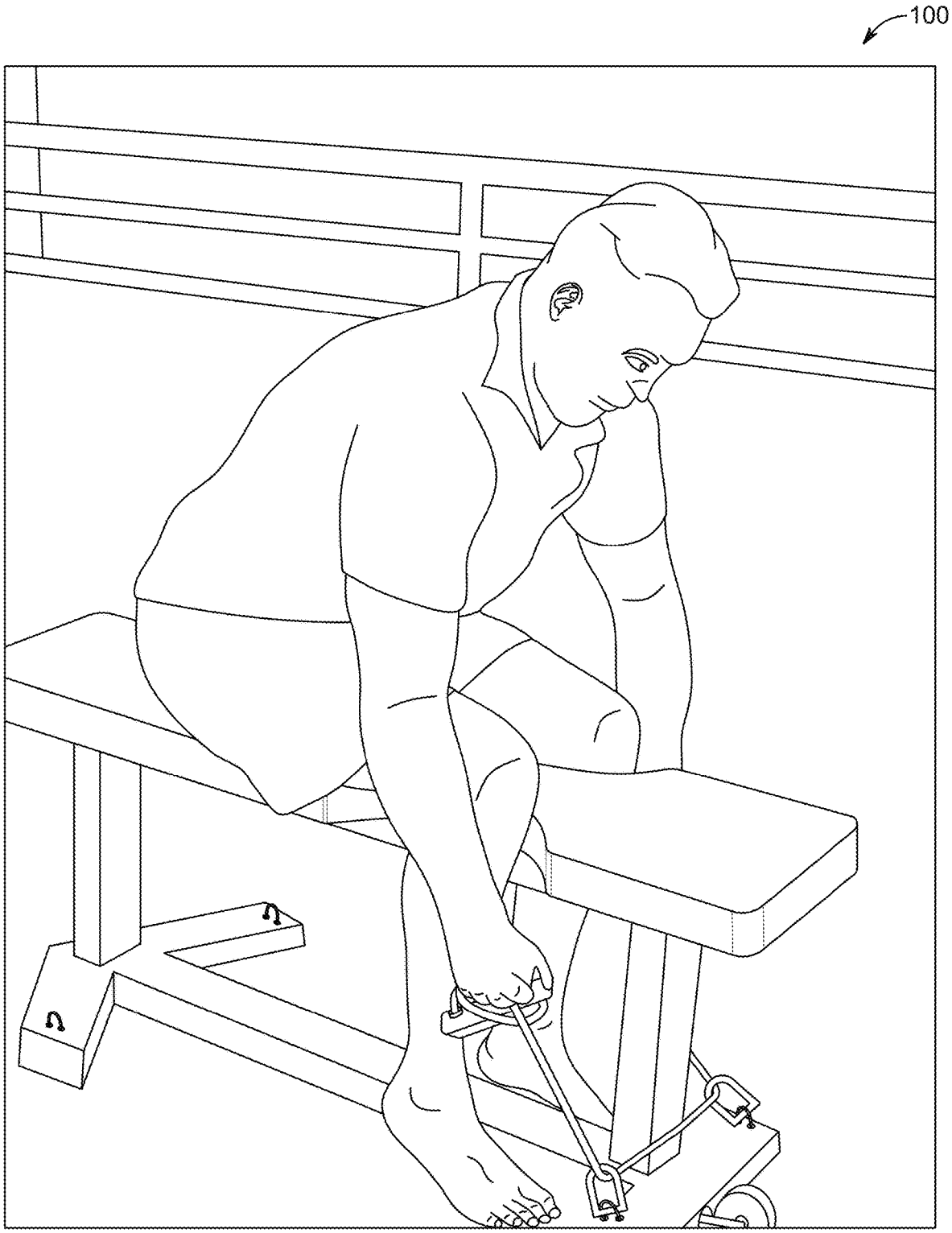

As mentioned above, the bench also has connections (rings/hooks/etc.) to provide for attachment-based exercises, such as rubber bands. As shown in FIG. 2J, for example, the user may connect rubber bands (e.g., through the rings, or with additional carabiners) in order to perform various exercises, such as bicep curls, bent-over rows, deltoid raises, and so on. Note that with the deep passthrough insets allowing for placement of the user's knees, as shown in FIG. 2K, certain exercises such as for the back can be performed using the bench, and particularly the rubber band attachments, without the user's legs getting in the way.

Figure 2L:
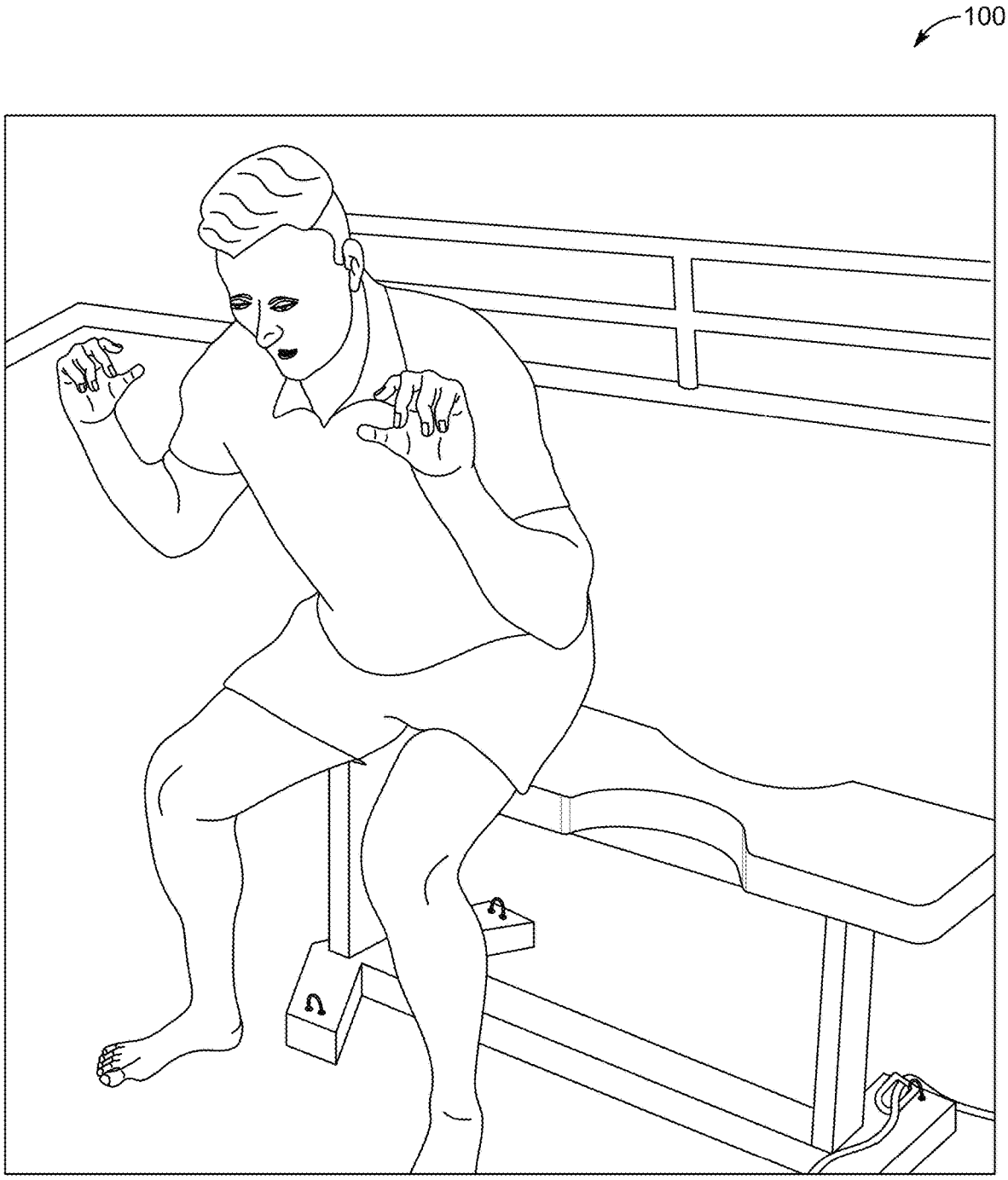
Figure 2M:
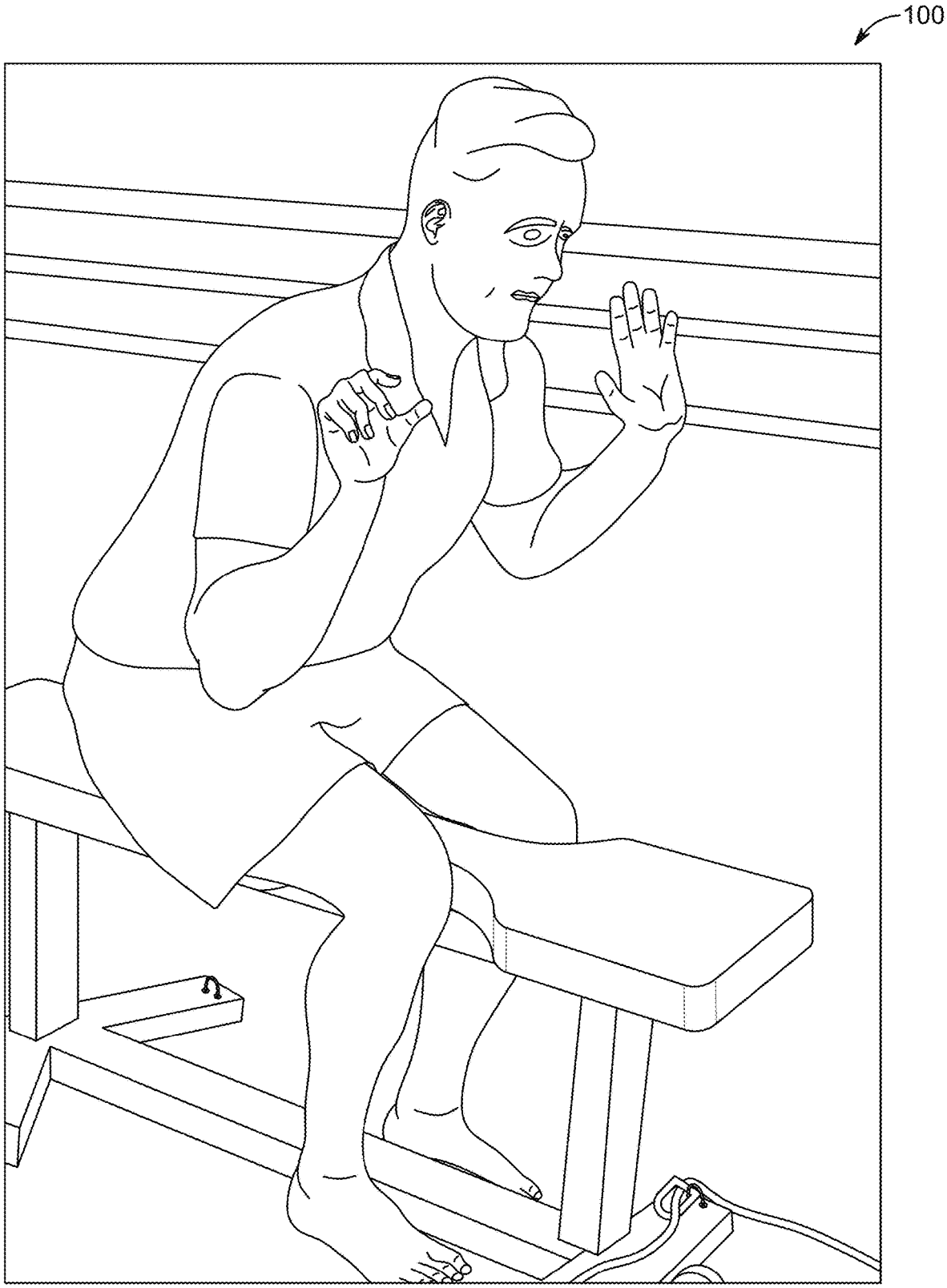
Figure 2N:
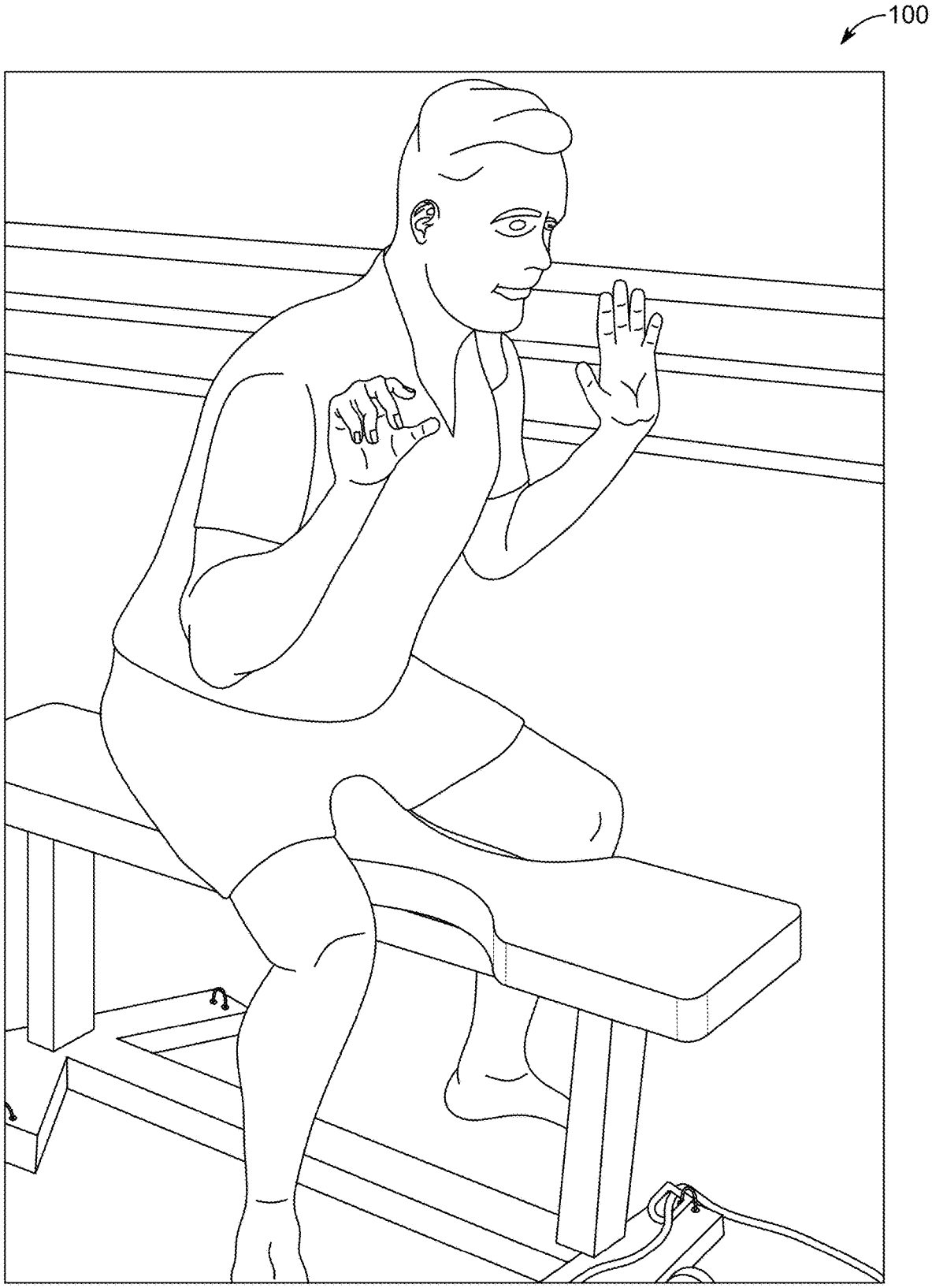
Figure 20:
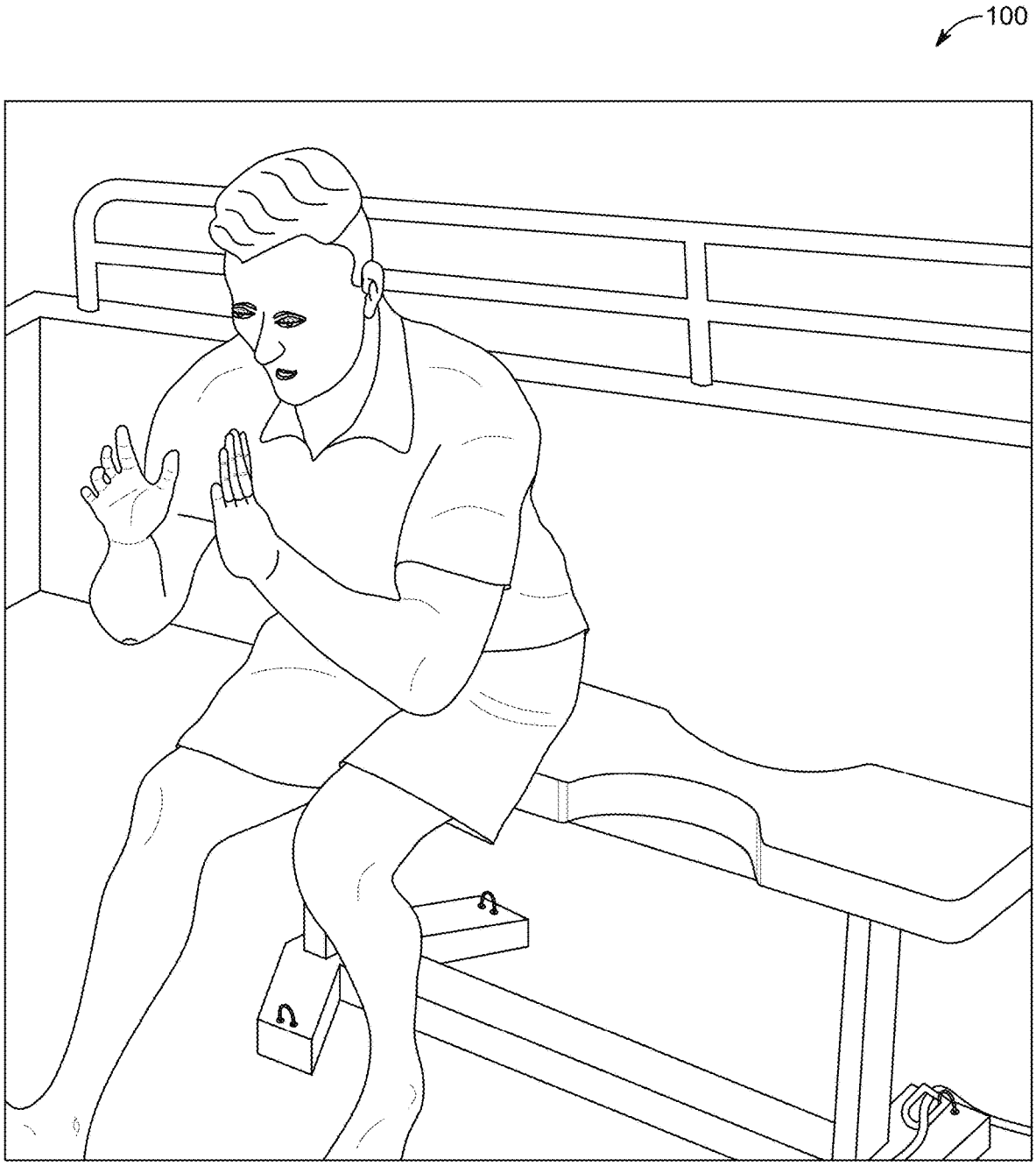

The height of the bench is also unique, being generally higher than most weight benches and designed specifically (solidly or adjustably) so that an average user's knees never go past 90-degrees for squats off the bench. For instance, as shown in FIG. 2L off the side of the bench for standard bench squats, FIG. 2M with the knees within the insets for narrow squats, or FIG. 2N for easily widening the legs from the same sitting position into wider squats, the bench herein allows for the user to never compromise their knees by going past 90-degrees. Also, as shown in FIG. 2O, the height allows for a single-leg squat, where the user can put of their weight on one foot, using the other just planted for balance, for great isolation during standing up and sitting down off the side of the bench (with weights or without).

Figure 3A:
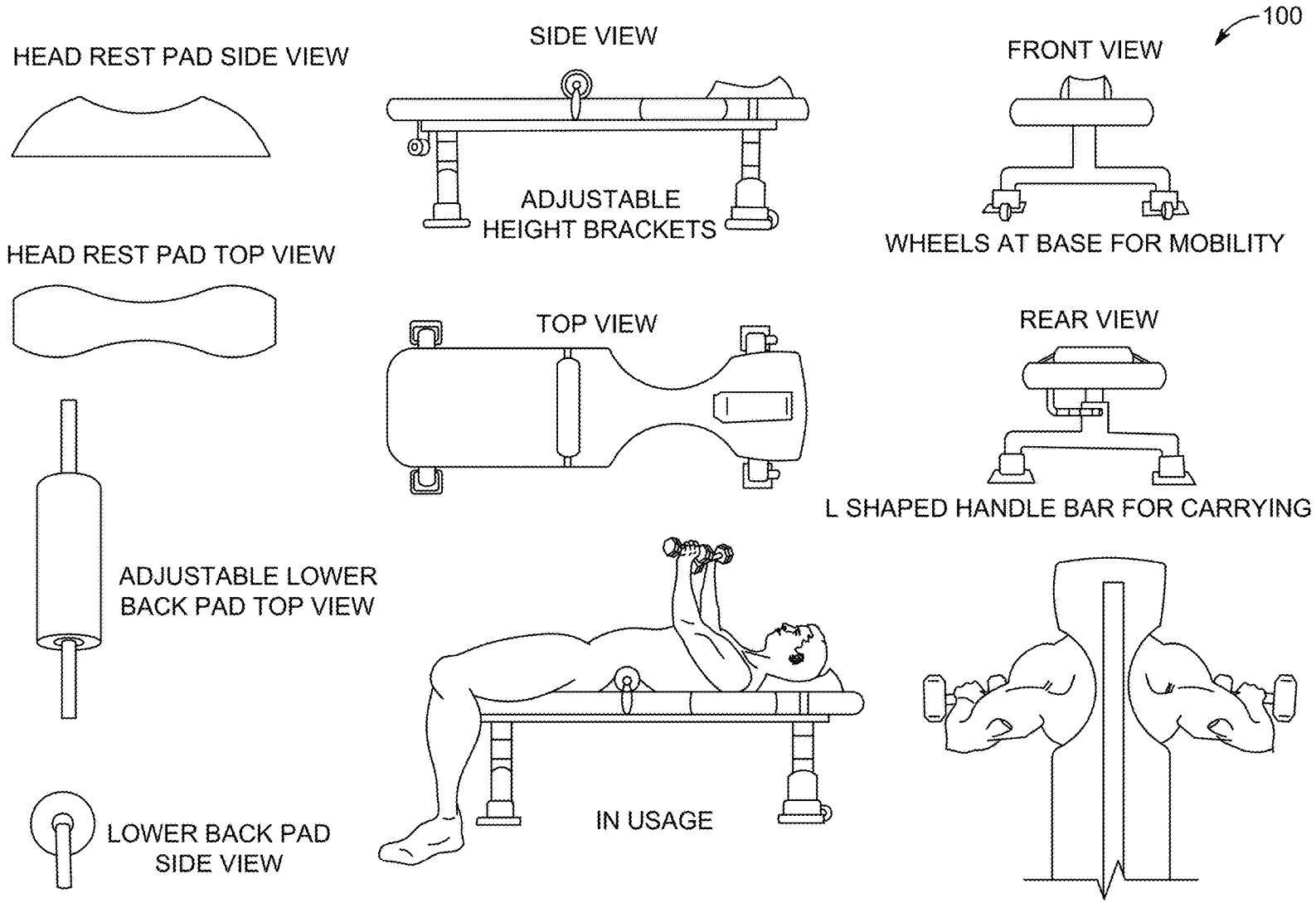
FIGS. 3A-3B illustrate alternative arrangements of the exercise bench with deep passthrough insets according to the present disclosure.
Figure 3B:
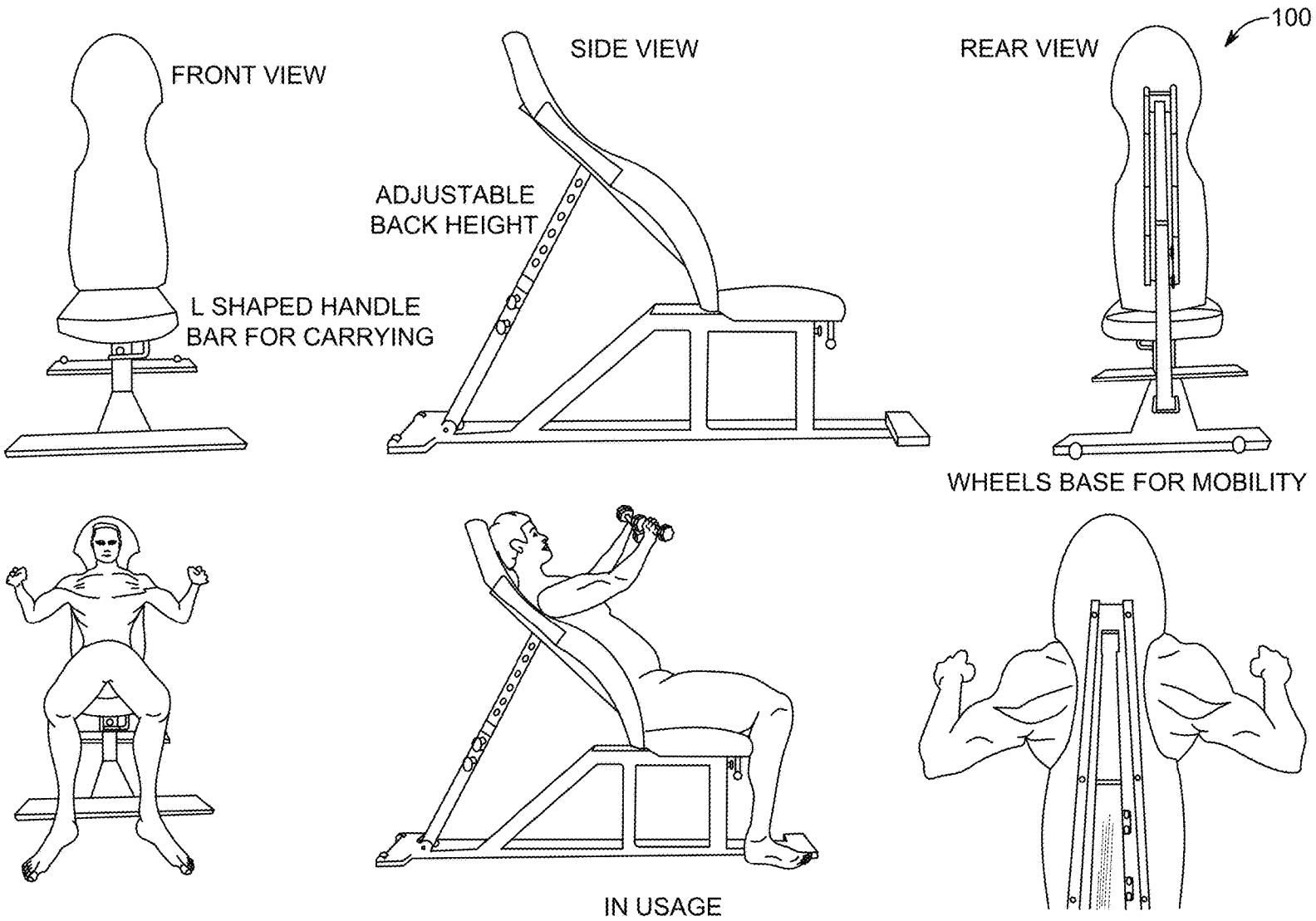

Lastly, FIGS. 3A-3B further illustrate alternative arrangements of the bench 100 herein, particularly with head rests, back support pads, adjustable incline angles, alternative base designs, and so forth. Any such configurations may be added to the bench as shown in FIGS. 1A-1D without departing from the scope of the present disclosure as may be appreciated by those skilled in the art.

As will also be appreciated, the above examples are intended only for the understanding of certain aspects of the techniques herein and are not limiting in nature. While the techniques are described primarily with respect to a free-stranding bench system, the disclosed embodiments may be configured with other devices and/or attachments according to further implementations.

In one specific embodiment, an exercise bench herein comprises: a frame having a top and bottom and a frame head-end and a frame tail-end at a distal end of the frame from the frame head-end; one or more head-end legs extending downward from the bottom of the frame head-end, the one or more head-end legs collectively establishing a head-end base at least as wide as the frame; one or more tail-end legs extending downward from the bottom of the frame tail-end, the one or more head-end legs collectively establishing a tail-end base at least as wide as the frame; and a user-support platform having: i) a solid base member supported by the top of the frame, the solid base member being generally rectangular and extending lengthwise from the frame head-end to the frame tail-end, and ii) a flexible resilient pad on top of the solid base member and configured in a substantially similar shape as the solid base member; wherein the user-support platform has first and second insets formed opposite each other and along opposing sides of the user-support platform, the first and second insets similarly formed within both the solid base member and the flexible resilient pad and located within a region of the user-support platform that would align with shoulder blades of a user lying against the user-support platform, the first and second insets being sufficiently deep enough to allow the shoulder blades of the user to have unencumbered mobility while the user was lying against the user-support platform while a spine of the user remains centrally supported by a portion of the user-support platform between the first and second insets, and wherein the frame exists under the portion of the user-support platform between the first and second insets.

In one embodiment, the first and second insets are substantially semicircular or semi-oval in shape.

In one embodiment, the first and second insets are substantially rectangular in shape.

In one embodiment, the exercise bench further comprises a cover member that substantially covers the flexible resilient pad. In one embodiment, the cover is removable.

In one embodiment, opposing ends of the tail-end base are angled inwards toward the head-end base.

In one embodiment, the one or more head-end legs and one or more tail-end legs each comprise a singular leg and the head-end base and the tail-end base are at least as wide as the frame.

In one embodiment, the one or more head-end legs and one or more tail-end legs each comprise two legs that together are at least as wide as the frame and the head-end base and the tail-end base are composed of independent feet at the ends of the two legs.

In one embodiment, the exercise bench further comprises: a handle affixed to the frame tail-end; and one or more wheels affixed to the head-end base.

In one embodiment, the exercise bench further comprises one or more hooks affixed to the head-end base, the tail-end base, or both.

In one embodiment, the one or more head-end legs and one or more tail-end legs are height adjustable.

In one embodiment, the user-support platform further comprises: a seat portion located at the frame tail-end; and a back portion located at the frame head-end, wherein the back portion is hinged and supported by the frame for adjustable incline angles.

In one embodiment, the exercise bench further comprises a head rest cushion.

In one embodiment, the exercise bench further comprises a back support pad.

Advantageously, the exercise bench with deep passthrough insets provides for proper chest and back isolation in laying down positions, and also alleviates obstruction by the user's legs in certain sitting positions, unlike any other weight bench currently in use. Specifically, having the pad and platform both having a deep cutout provides complete passthrough ability for the user's shoulder blades and legs. Certain other benches with tapers or shaped pads do not reach the level of unobstructed use, and are merely built primarily for comfort, not for actually changing the types of exercises that can be performed. Some benches have small cutouts in the supporting platform, but have a pad that is still generally rectangular in shape, thus allowing for increased flexibility in the pad beneath the shoulder blades, but still not any passthrough capability, and not as deeply cut as the present invention's insets (again, merely for comfort during conventional bench press exercises). Other benches still actually provide an even wider shoulder portion for support, thus having completely the opposite effect as the desired unencumbered outcomes herein.

The foregoing description has been directed to specific embodiments. It will be apparent, however, that other variations and modifications may be made to the described embodiments, with the attainment of some or all of their advantages. Accordingly, this description is to be taken only by way of example and not to otherwise limit the scope of the embodiments herein. Therefore, it is the object of the appended claims to cover all such variations and modifications as come within the true spirit and scope of the embodiments herein.

What is claimed is:

1. An exercise bench, comprising:

a frame having a head-end and a tail-end, the frame extending lengthwise between the head-end and the tail-end and having a top side and a bottom side;

one or more head-end legs extending downward from the bottom side of the head-end of the frame, the one or more head-end legs collectively establishing a head-end base at least as wide as the frame;

one or more tail-end legs extending downward from the bottom side of the tail-end of the frame, the one or more tail-end legs collectively establishing a tail-end base at least as wide as the frame, the one or more tail-end legs forming a base that is angled inward toward the frame to avoid interference with feet or legs of a user during seated or lying exercises; and a user-support platform supported by the top side of the frame and having:

i) a solid base member extending lengthwise from the head-end to the tail-end of the frame and being generally rectangular, and ii) a flexible resilient pad disposed on the solid base member and configured in a substantially similar shape as the solid base member;

wherein both the solid base member and the flexible resilient pad define first and second through-cutouts formed opposite one another along opposing sides of the user-support platform, each through-cutout extending entirely through both the solid base member and the flexible resilient pad to define an open lateral void and located within a region of the user-support platform that would align with shoulder blades of a user lying against the user-support platform, wherein the first and second through-cutouts each have a depth sufficient to allow an entire shoulder blade of the user to move below a plane of remaining portions of the user-support platform during full-range chest and deltoid exercises, thereby allowing the user to have unencumbered mobility of shoulder blades of the user while the user was lying against the user-support platform while a spine of the user remains centrally supported by a portion of the user-support platform between the first and second through-cutouts, wherein the frame supports only a central portion of the user-support platform between the first and second through-cutouts such that no frame member underlies the first and second through-cutouts, such that the first and second through-cutouts provide unobstructed motion of arms, legs, or bands of the user during seated or supine exercises, wherein the exercise bench further comprises attachment members affixed to at least one of the one or more head-end legs or the one or more tail-end legs and configured to receive an exercise accessory or resistance band, and wherein the one or more head-end legs and the one or more tail-end legs are height-adjustable to maintain a knee angle not greater than ninety degrees when the user is seated on the user-support platform.

2. The exercise bench as in claim 1, wherein the first and second through-cutouts are substantially semicircular or semi-oval in shape.

3. The exercise bench as in claim 1, wherein the first and second through-cutouts are substantially rectangular in shape.

4. The exercise bench as in claim 1, further comprising:

a cover member that substantially covers the flexible resilient pad.

5. The exercise bench as in claim 4, wherein the cover member is removable.

6. The exercise bench as in claim 1, wherein the one or more head-end legs and one or more tail-end legs each comprise a singular leg and wherein the head-end base and the tail-end base are at least as wide as the frame.

7. The exercise bench as in claim 1, wherein the one or more head-end legs and one or more tail-end legs each comprise two legs that together are at least as wide as the frame and wherein the head-end base and the tail-end base are composed of independent feet at corresponding ends of the two legs.

8. The exercise bench as in claim 1, further comprising:

a handle affixed to the tail-end of the frame; and one or more wheels affixed to the head-end base.

9. The exercise bench as in claim 1, wherein the user-support platform further comprises:

a seat portion located at the tail-end of the frame; and a back portion located at the head-end of the frame, wherein the back portion is hinged and supported by the frame for adjustable incline angles.

10. The exercise bench as in claim 1, further comprising:

a head rest cushion.

11. The exercise bench as in claim 1, further comprising:

a back support pad.

* * * * *